US006024970A

United States Patent [19]

Woodard

[11] Patent Number: 6,024,970

[45] Date of Patent: Feb. 15, 2000

[54] LINT GLOVE

[75] Inventor: Marjorie P. Woodard, 1613 Eagle Dr., Edmond, Okla. 73034

[73] Assignee: Marjorie P. Woodard, Edmond, Okla.

[21] Appl. No.: 08/972,065

[22] Filed: Nov. 17, 1997

[51] Int. Cl.[7] ..... A01N 25/34; A47L 13/18

[52] U.S. Cl. ..... 424/402; 441/57; 401/7; 229/87.16; 15/227; 2/20; 2/158; 2/159; 2/270

[58] Field of Search ..... 2/20, 158, 159, 2/270; 15/227; 229/87.16; 401/7; 441/57; 424/402

[56] References Cited

U.S. PATENT DOCUMENTS

| | | | |
|---|---|---|---|
| Re. 35,814 | 6/1998 | Olson . | |
| 2,724,847 | 11/1955 | Krasno | 15/104 |
| 3,056,154 | 10/1962 | Neal . | |
| 3,082,453 | 3/1963 | Mutchler et al. | 15/104 |
| 3,089,170 | 5/1963 | Buchsbaum | 15/105 |
| 3,103,029 | 9/1963 | Valles | 15/227 |
| 4,427,726 | 1/1984 | Wolfrum | 428/43 |
| 4,510,640 | 4/1985 | Omori | 15/104 |
| 4,797,967 | 1/1989 | Lengers . | |
| 4,820,558 | 4/1989 | Sundberg | 428/34.3 |
| 5,008,969 | 4/1991 | Jarrett . | |
| 5,280,664 | 1/1994 | Lin . | |
| 5,524,575 | 6/1996 | Lennon . | |

OTHER PUBLICATIONS

R.C. Steele® Wholesale Pet and Animal Care Supplies, Midsummer 1997 Catalog, p. 37, Pet Hair Grabber.

R.C. Steele® Wholesale Pet and Animal Care Supplies, Midsummer 1997 Catalog, p. 42, Grooming Gloves.

*Primary Examiner*—Thurman K. Page
*Assistant Examiner*—Brian K. Seidleck
*Attorney, Agent, or Firm*—Dunlap, Codding & Rogers, P.C.

[57] ABSTRACT

A lint mitt having a compartment for a user's fingers, a compartment for a user's thumb, and which firmly holds the mitt about a user's wrist. The lint mitt has disposed thereon an adhesive having sufficient tack to adhere lint to the lint mitt when the lint mitt is disposed upon a lint-filled surface. Methods for using a lint mitt.

12 Claims, 3 Drawing Sheets

LINT GLOVE

CROSS REFERENCE TO RELATED APPLICATIONS

Not Applicable.

STATEMENT TO RIGHTS TO INVENTIONS MADE UNDER FEDERALLY SPONSORED RESEARCH AND DEVELOPMENT

Not Applicable.

BACKGROUND OF THE INVENTION

Field of the Invention

This invention generally relates to mitts for removing lint, hair, and other fibrous and particulate matter and materials from a selected surface, and, more particularly, to lint mitts used to remove hair and other unwanted fibers and particulate matter from surfaces such as, but not limited to, clothing, furniture, bedding, car upholstery, and the like, and the methods of using same.

Background Information

Description of Related Art Including Information Disclosed Under 37 CFR 1.97 and 37 CFR 1.98

Devices and materials for removing lint (the term "lint", as used herein, means fibers from both natural and/or synthetic sources, including hair from any animal, and any natural and/or synthetic particles and/or particulate matter) have been developed and used for removing unwanted fibrous materials. The material used to remove lint is often a paper-type material having an adhesive thereon, such as a masking tape. A device for removing lint would include a roller having a roll of adhesive tape thereon.

An adhesive-type tape, alone, removes lint and the like, but is difficult and unwieldy to hold for such lint removal. Such devices are known, and shown, in U.S. Pat. Nos. 4,820,558, 3,103,029, 3,056,154, 3,082,453, 2,724,847, each of which illustrates a sack-like device in which a user can insert a hand or fingers. Such devices roll about on, and/or, pull off of a user's hand or fingers, and provided little control over lint removal.

Hand-held devices, such as blocks and tape dispensers, such as U.S. Pat. Nos. 3,299,461 and 3,089,170, respectively also have been utilized to remove lint, but require a separate apparatus to control upon which a supply of adhesive tape must be continually adjusted and maintained.

Roll and roller-type devices, such as U.S. Pat. Nos. 2,702,913 and 4,427,726, respectively, having an adhesive tape thereon have proven more useful, but still have the limitation of less control over removing the lint from a specified surface due to the need to manipulate a roll, or a rolling roller, and the need to adjust and maintain the adhesive tape on the roll or roller.

Mitts having adhesive thereon which enclose a user's fingers, but fail to incorporate into the user's thumb, such as U.S. Pat. No. 3,056,154, also have disadvantages. The user can pat or brush the desired surface, but cannot control the mitt if the mitt would come loose from the fingers; without retention of the thumb and without securing the mitt about the user's wrist the mitt using only fingers can inadvertently fall off during use.

Therefore, there is a need felt within the art for a lint removal device adapted to fitting a user's hand, where the pressure applied to a specific surface could be controlled more accurately by the user, where the mitt would envelop a sufficient amount of a users thumb and fingers to hold the mitt in place without significant rotation or rolling of the mitt, where the mitt could be easily secured about the user's wrist so that the mitt would not readily fall or be pulled off, where the thumb and finger junction of the user's hand could be used to partially or completely encompass some selected surfaces, and where a user could target an adhesive area on such a device to pick up either more or less lint. Such a device would be economical to manufacture and supply, easy for a user to use, and would provide pressure control by the user as well as various adhesive surface areas to pick up lint from certain surfaces.

An objective of the present invention is to provide a lint mitt which has adhesive on at least a portion of one surface, and which has at least one space for a user's thumb and at least one other space for a user's fingers. A further goal of the present invention is to provide a lint mitt which easily slips on a user's hand, and which, in the junction between fingers and thumb, permits a user to have good control over applying the adhesive on the mitt to the selected surface to be cleaned of lint. It is a further objective of the present invention that the lint mitt be disposable, or alternatively, have a primary disposable element which includes the primary adhesive element which attracts and adheres the lint. It is a further goal of the present invention that the lint mitt, or at least primary components thereof, be easily and economically manufactured, due to its relatively simple construction.

SUMMARY OF THE INVENTION

The present invention defines an apparatus for removing lint, which comprises a cover for a user's hand. The cover has a palm surface comprising at least one sheet of material and a back surface. An adhesive is disposed upon at least a portion of at least one sheet comprising the palm surface. The adhesive has sufficient adhesive qualities to adhere lint to the adhesive. The cover also has a top end and a bottom end, and the cover has an opening at the bottom end which defines an inner retaining space. The inner retaining space is sized to hold a user's hand when a hand is inserted into the inner retaining space. The inner retaining space has a thumb compartment for holding the cover about a user's thumb, a finger compartment for holding the cover about all of a user's fingers, and a wrist compartment for holding the cover about at least a portion of a user's wrist. The cover engages a user's wrist such that the wrist compartment of the cover is held in a firm engagement about a user's wrist thereby preventing the cover from sliding off of a user's hand. The thumb compartment of the cover holds a user's thumb such that the cover is retained on a user's hand such that a user's palm is held adjacent the palm surface and a back of a user's hand is held adjacent the back surface of the cover. In this manner, the cover is retained in a non-rotatable position about a user's hand. At least the portion of the palm surface having the adhesive thereon adheres lint thereto when a user disposes that portion upon a lint-covered surface.

The present invention also defines a method for providing a lint removing device. A cover is provided for a user's hand, the cover having a palm surface comprising at least one sheet of material and a back surface. An adhesive is disposed upon at least a portion of at least one sheet comprising the palm surface. The adhesive has sufficient adhesive qualities to adhere lint thereto when the portion of the palm surface is disposed upon a surface having lint thereon. The cover also has a top end and a bottom end, and an opening at the bottom end defining an inner retaining space. The inner retaining space is sized to hold a user's hand when a hand is inserted into the inner retaining space. The inner retaining space further comprising a thumb compartment for holding the cover about a user's thumb, a finger compartment for holding the cover about all of a user's fingers, and a wrist compartment for holding the cover about at least a portion of a user's wrist.

The method includes inserting a user's hand into the inner retaining space of the cover. In this manner, the user's thumb is retained in the thumb compartment, the user's fingers are retained in the finger compartment and the user's wrist is retained adjacent the wrist compartment.

Thereafter, the cover is bound to the user's wrist, wherein at least a portion of the wrist compartment of the cover is held in a firm engagement about the user's wrist thereby both retaining the cover on the user's hand and preventing rotation of the cover about the user's hand. After the cover is bound about the user's wrist, the cover is ready for use by the user to remove lint from a surface.

BRIEF DESCRIPTION OF THE DRAWINGS

Other objects, features and advantages of the present invention will become more fully apparent from the following detailed descriptions of the preferred embodiments, the appended claims and the accompanying drawings in which:

DESCRIPTION OF THE PREFERRED EMBODIMENTS

Figure 1:
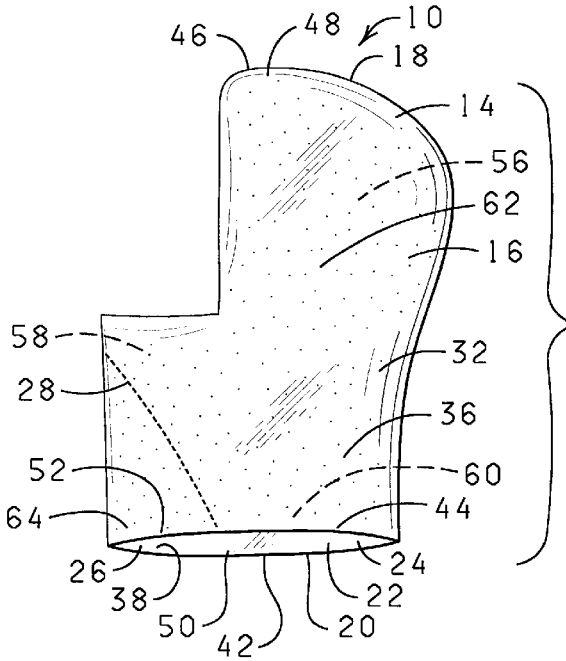
FIG. 1 is a perspective view of the lint mitt constructed in accordance with the present invention.
Figure 2:
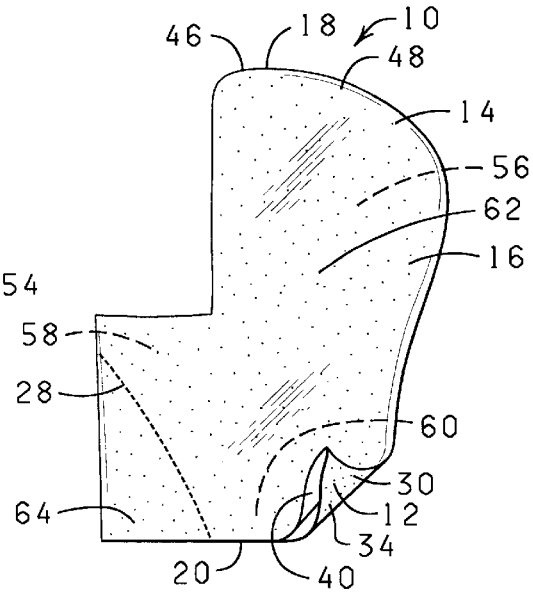
FIG. 2 is a top plan view of the lint mint shown in FIG. 1, but showing an edge lifted to show, partially, the opposite side of the lint mint and to illustrate the first sheet of material and the second sheet of material which form the lint mitt.

The Embodiments and Methods of FIGS. 1–5

Apparatus, and methods for removing lint, have been known in the art. Most of these apparatus and methods, however, did not provide quick, easy and well controlled lint removal. The present device utilizes a mitt having an adhesive coating on at least the entire palm surface of the mitt. The present mitt also is adapted to fit a user's hand. The mitt fits over the fingers and the thumb, and then secures around the user's wrist. This permits the mitt to remain in place on the user's hand without rolling, and permits the mitt to remain on the user's hand without easily being pulled off, since the mitt is secured about the user's wrist.

Such a mitt also permits more control of lint removal, permitting the user more control over brushing and stroking surfaces, as well as even partially or completely encircling surfaces by using the thumb and finger junction of the user's hand. The present lint mitt may also be provided with all surfaces being adhesive, so that when one surface is lint-coated, the user could simply switch the mitt to the other hand, and use the non-lint covered surface to continue removing lint.

The present lint mitt could also be provided, in another embodiment, to have a mitt which is secured over the fingers and thumb, and which holds the mitt to the hand by some tension about the wrist. The mitt of this embodiment has a removable sheet on at least the palm surface, and possibly removable sheets for both the palm surface and the back-of-the-hand surface. The removable sheet would connect to the mitt, but when the sheet became lint-filled, it would be removable, and another sheet could be applied. Or, in another alternative, several sheets of material having an exposed adhesive coating, in a small pad of such sheets of material, would be connected to at least one surface of the mitt. When the outer-most sheet of material became lint-coated, that sheet would be removed, exposing a fresh, adhesive-coated sheet ready to pick up additional lint.

In addition, the adhesive coating of either embodiment of the present lint mitt may have varying areas of tack of the adhesive. That is, some areas may have greater adhesion qualities; some areas would have a lesser degree. Further, some areas of the lint mitt and/or sheet of material could be embossed, permitting a varying degree of tack and adhesive qualities for removing various type and amounts of lint.

Finally, either the entire lint mitt, or, alternatively, a portion of the lint mitt, is disposable. The present lint mitt is made of materials which permit the present lint mitt to be easily and economically manufactured, due to its relatively simple construction.

Referring now to FIGS. 1–5, designated generally by the reference numeral 10 is a lint mitt which is constructed in accordance with the present invention. The lint mitt 10 comprises a palm surface 12 and a back-of-the-hand surface (hereinafter "back surface") 14, which are connected together to form an outer surface 16. The lint mitt 10 has an upper end 18 and a lower end 20. The lower end 20 is intersected by an opening 22 which forms an inner surface 24 and a hand receiving space 26 for accepting, in one compartment, the user's fingers and, in another connected compartment, the user's thumb. The outer surface may have fold lines 28 on either the palm surface 12 or the back surface 14. These fold lines direct the user, after placing a hand in the lint mitt 10, to fold the mitt along the fold lines 28, permitting a portion of the lint mitt 10 to fold about the user's hand and wrist, thereby securing the lower end 20 of the lint mitt 10 about the user's wrist so that the lint mitt 10 will not easily fall off or slip off of the user's hand while being used to remove lint.

The lint mitt 10 is constructed from at least a first sheet of material 30. In the embodiment shown in FIGS. 1–5, the lint mitt comprises a first sheet of material 30 and a second sheet of material 32. Both the first and second sheets of material 30 and 32, respectively, have a thickness in a range from about 0.1 mils to about 20 mils. Preferably, the first and second sheets of material 30 and 32 have a thickness in a range from about 0.5 mils to about 15 mils.

The first and second sheets of material 30 and 32 each have an outer surface 34 and 36, respectively, an inner surface 38 and 40, respectively, and an outer peripheral edge 42 and 44, respectively. Each of the first and second sheets of material 30 and 32 has a top end 46 and 48, respectively and a bottom end 50 and 52, respectively.

The first and second sheets of material 30 and 32, respectively, may be constructed of a single layer of material or a plurality of layers of the same or different types of materials. Any thickness of the first and/or second sheets of material 30 and 32 may be utilized in accordance with the present invention as long as the first and second sheets of material 30 and 32 are usable as a lint mitt, as described herein. The layers of material comprising the first and second sheets of material 30 and 32 may be connected together or laminated or may be separate layers.

In forming the lint mitt 10, the inner surface 38 of the first sheet of material 30 is aligned with the inner surface 40 of the second sheet of material 32. The two sheets of material 30 and 32 are then connected together along their outer peripheral edges 42 and 44, respectively, except at the bottom ends 50 and 52, respectively. The connection of the first and second sheet of material 30 and 32, respectively, is made by heat sealing the first and second sheets of material 30 and 32 together, by adhering via an adhesive (not shown) the first and second sheets of material 30 and 32 together, or by any other method or means known in the art. Alternatively, the first and second sheets of material 30 and 32 are formed as a single sheet of material (not shown), and thereby, as an example but not by way of limitation, could be formed to overlap along, for instance, junction 54 and connect at the other locations described above and shown in FIGS. 1–5 such that a lint mitt 10 closely resembling the one described above is the result. In another alternative (not shown), the lint mitt 10 is formed from a continuous web of material, resulting in a lint mitt 10 with little or no seams or overlapping connection areas.

In forming the lint mitt, the first and second sheets of material 30 and 32 are aligned and connected together as described above, and as shown in FIGS. 1–5. When a user's hand is inserted into the lint mitt 10, the lint mitt 10 generally conforms to the general outline of a user's hand. That is, the lint mitt 10 has, in the hand receiving space 26, a finger compartment 56, a thumb compartment 58 and a wrist compartment 60.

The lint mitt 10 is constructed from any suitable material that is capable of being utilized as the lint mitt 10 described herein. Frequently, the lint mitt 10 will be constructed from a material comprising paper (untreated or treated in any manner), cellophane, foil, polymer film, fabric (woven or nonwoven or synthetic or natural), or combinations thereof. In one embodiment, the lint mitt is constructed from a polypropylene material.

The lint mitt 10 may have various colorings, coatings, embossing, flocking, or other decorative surface ornamentation applied separately or simultaneously or may be characterized totally or partially by pearlescent, translucent, transparent, iridescent, neon or the like, qualities. Each of the above-named characteristics may occur alone or in combination and may be applied to the outer and/or inner surfaces 16 and 24 respectively, of the lint mitt 10. Moreover, each surface of the lint mitt 10 may vary in the combination of such characteristics. The lint mitt 10 may be opaque, translucent or clear, partially clear or tinted transparent.

An adhesive 62 is applied to at least a portion of the outer surface 16 of the lint mitt 10. In the embodiment of FIGS. 1–5, the adhesive 62 is shown applied to substantially the entire outer surface 16 of the lint mitt 10. The adhesive 62 may be a pressure sensitive adhesive, or, alternatively, may comprise any other adhesive that operates to adhere and hold lint thereto, and operates as described herein. The adhesive 62 may have qualities which permit the surface of the lint mitt 10 having adhesive 62 thereon to be washed to remove the lint therefrom, permitting the surface of the lint mitt 10 to be re-used to remove lint. It will be understood that a release sheet (not shown) may be applied over the adhesive 62 so that the adhesive 62 retains tack until such time that the release sheet is removed and the adhesive 62 on the lint mitt 10 is used to remove lint.

It will be appreciated that, as described previously, the adhesive 62 may have varying areas of tack; that is, some areas of greater adhesion qualities and/or some areas of lesser degree of adhesion. In addition, the first and/or second sheets of material 30 and 32, respectively, forming the lint mitt 10 may also have embossing on at least a portion thereof. This embossing, when on an area of the lint mitt 10 having adhesive 62, would again cause a greater amount of lint to be collected in areas of the lint mitt 10 which formed in a more convex orientation with respect to the surface having the lint thereon, with lesser amounts of lint being collected in areas of the lint mitt 10 which were more concave with respect to the selected, lint-filled surface.

Figure 3:
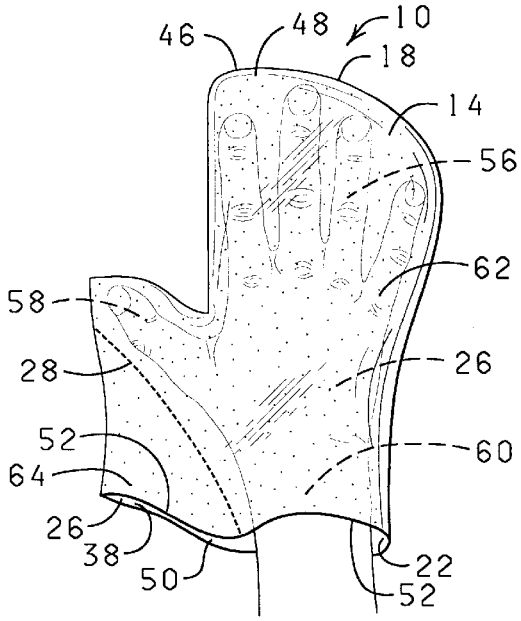
FIG. 3 is a perspective view of the lint mint shown in FIG. 1, but showing a user's hand inserted into the opening of the lint mitt.
Figure 4:
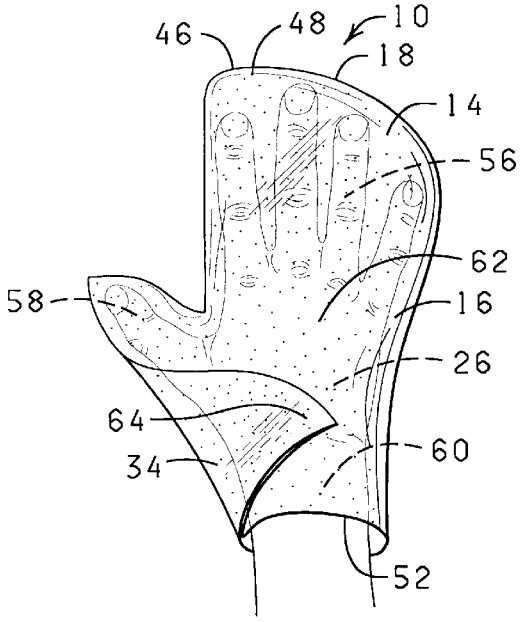
FIG. 4 is a perspective view of the lint mitt shown in FIG. 1, but showing the lint mint connected to itself such that the lint mitt is held in place about the user's hand.
Figure 5:
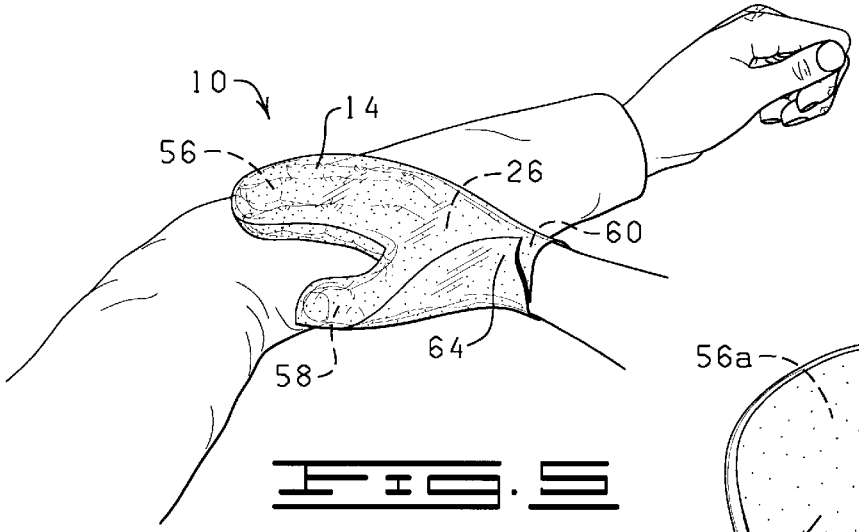
FIG. 5 is a perspective view of a user's hand in the lint mitt as shown in FIG. 4, but showing the user partially encompassing, via the user's fingers and thumb in the lint mitt, an arm in a sleeve to remove the lint from the sleeve.

Turning now to a method of using the lint mitt 10, FIGS. 3–5 illustrate one method of use. In this instance, a user's hand is inserted such that the user's fingers are contained within the finger compartment 56, the user's thumb is contained within the thumb compartment 58, and the lint mitt 10 drapes over at least a portion of the user's wrist such that the portion of the user's wrist is at least partially enclosed in the wrist compartment 60. The corner 64 of the lint mitt 10 is then folded along the designated fold lines 28 along either the palm surface 12 of the lint mitt 10 or, alternatively, along the back surface 14 of the lint mitt 10, thereby encompassing the lint mitt 10 about the user's hand, and securing the lint mitt 10 onto the user's hand by firmly holding and securing the wrist compartment 60 of the lint mitt 10 about the user's wrist.

In another alternative, the corner 64 could be formed such that the first sheet of material 30 and the second sheet of material 32 are not connected together from about the upper tip of the thumb to the lower end 20 such that the opening 22 of the lint mitt 10 comprises both the corner 64 and the lower end 20 of the lint mitt 10. In this manner one sheet, for example, but not by way of limitation, the corner 64 of the first sheet of material 30 could overlap the corner 64 of the second sheet of material 32, the adhesive on the second sheet of material 32 contacting and adhesively connecting to the first sheet of material 30 thereby causing the lint mitt 10 to become firmly connected about a user's wrist, at least a portion of the user's wrist contained within the wrist compartment 60 of the lint mitt 10, thereby holding the lint mitt 10 firmly on the user's hand.

In a further alternative, the lint mitt 10 could have a pull tab (not shown) connected near the lower end 20 of the lint mitt 10. The pull tab could be used to crimp, or gather, the lower end 20 of the lint mitt 10 about a user's wrist, thereby securing the lint mitt 10 and, especially, the wrist compartment 60 of the lint mitt 10 in a close, secure engagement, thereby permitting the lint mitt 10 to remain in place on the user's hand until the pull tab (not shown) is released by the user.

Such a pull tab could be provided as a separate sheet of material, or could be integral to the lint mitt 10. The pull tab could be sized such that the user could easily grasp the pull tab for securing the lint mitt 10 about the user's wrist, and for removing the lint mitt 10 from the user's wrist. Further, the pull tab could optionally be provided with an adhesive or cohesive material thereon, for connecting the pull tab about the lower end 20 of the lint mitt 10, to at least partially encompass the user's wrist such that the lint mitt 10 remains on the user's hand. It will be appreciated that such a pull tab could also be provided with a release sheet thereon.

In another alternative, the lint mitt 10 may be crimped about a user's wrist. It will be appreciated that the lint mitt 10 may, in other alternatives, be held about a user's wrist by any means or method described herein, or by any means or method known in the art.

Once the lint mitt 10 is in place on the user's hand, the lint mitt 10 is held in place by the user's fingers in the finger compartment 56 along with the user's thumb in the thumb compartment 58, which act cooperatively to keep the lint mitt 10 from rolling about the user's hand, and by the folding or crimping of the lint mitt 10 about the user's wrist, such that the wrist is at least partially encompassed in the lint mitt 10, and the lint mitt 10 is secured about or upon the user's wrist. When the lint mitt 10 is fitted on the user's hand such that the user's wrist is closely encompassed by the wrist compartment 60, the lint mitt 10 will not readily slip off a user's hand when the fingers and thumb of the user are pointed downward, or placed in any other direction.

The user may then pat, stroke, and/or partially encompass or completely encompass an object, such as a user's arm, in the user's hand via the palm surface 12 and/or the back surface 14 in order to remove lint and the like from the desired surface. In addition, when one surface, such as, for example but not by way of limitation, the palm surface 12 becomes filled with lint, the user may either use the back surface 14 of the lint mitt 10, or may remove the lint mitt 10 from the one hand by detaching the corner 64 of the lint mitt 10, removing the lint mitt from the one hand, and inserting the opposite hand into the lint mitt 10 and reconnect the corner 64 along fold lines (or disconnecting the lint mitt 10 or reconnecting the lint mitt via a pull tab (not shown), or any other means and/or method described herein), such that the unused surface of the lint mitt 10 is now disposed adjacent the palm of the user, so that the unused surface of the lint mitt now becomes the palm surface 12, and may be used to remove additional lint from the selected surfaces. It will be appreciated that when all surfaces of the lint mitt 10 are filled with lint, the lint mitt 10 may be discarded. Alternatively, if an adhesive 62 that retains tack after rinsing with water is used on the lint mitt 10, the lint mitt 10 may be rinsed off with water to remove the lint, and re-used until such time that the tack of the adhesive 62 is inoperative to pick up lint.

The Embodiments and Methods of FIGS. 6–12

Figure 6:
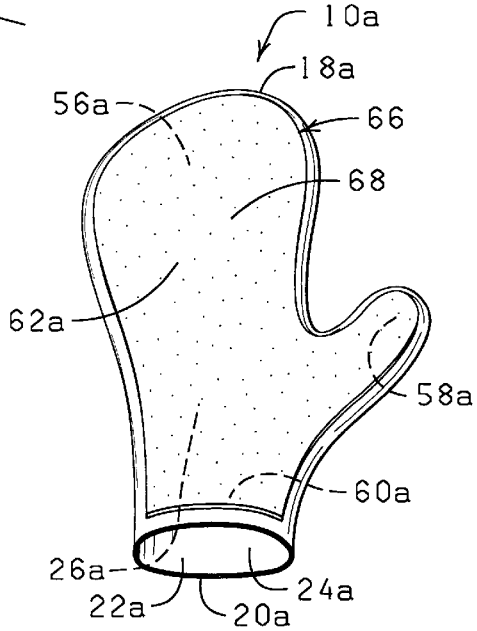
FIG. 6 is a perspective view of another embodiment of the lint mint of the present invention, the lint mitt comprising a primary mitten and having a separate, disposable sheet of material connected to the lint mitt.
Figure 8:
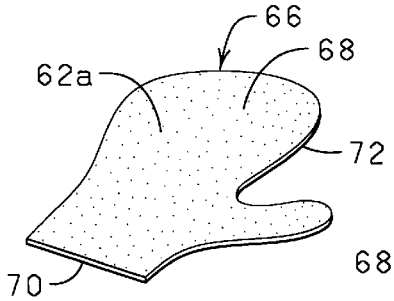
FIG. 8 is a perspective view of the disposable sheet of material shown in FIGS. 6 and 7.
Figure 9:
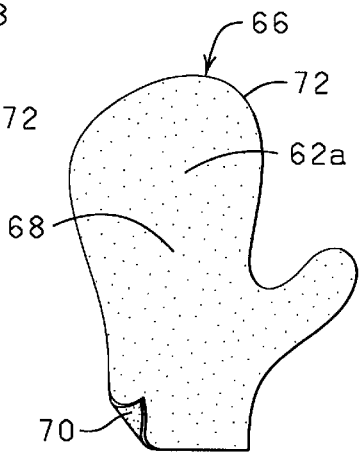
FIG. 9 is a top plan view of the disposable sheet of material shown in FIGS. 6–8.

Referring to FIGS. 6–12, as shown herein and designated by the general reference numeral 10a is another lint mitt constructed in accordance with the previously disclosed lint mitt 10. In an alternative, however, the lint mitt 10*a* may be constructed as a regular mitten-type mitt having a thumb compartment 58*a*, a finger compartment 56*a* and a wrist compartment 60*a*, and being constructed from any material described herein, but where the corner 64 is not present, as shown in FIG. 6, and where the lint mitt 10*a* is held about the user's wrist via a pull tab (not shown) or via any elastic material, draw string material, or other material which permits expansion and then contraction (for example, but not by way of limitation, SPANDEX®), or via a connectable-type material such as, for example but not by way of limitation, a hook and loop-type material (such as, for example only, VELCRO®), and/or via any other means known in the art which would hold the wrist compartment 60*a* of the lint mitt 10*a* in an engagement with the user's wrist sufficient to prevent the lint mitt 10*a* from easily slipping off of the user's hand. Such an alternative lint mitt 10*a* may also be provided with a different material comprising the palm surface 12*a* and/or back surface 14*a*.

In addition, the lint mitt 10*a* comprises an additional sheet of material, hereinafter termed the "disposable sheet 66", which is attached to the palm surface 12*a* of the lint mitt 10*a*. The disposable sheet 66 may have the general configuration of the palm surface 12*a* of the lint mitt 10*a*. Alternatively, however, the disposable sheet 66 may have a configuration comprising any geometric and/or any non-geometric shape, as long as the disposable sheet 66 operates in the manner described herein to remove lint. The disposable sheet 66 has the same characteristics and is constructed from the same materials as those previously described for the first and second sheets of material 30 and 32, respectively, as well as those described for the lint mitt 10, and has an adhesive 62*a* disposed upon at least one surface thereof. In a different embodiment (not shown) a disposable sheet 66 could also be connected to the back surface 14*a* of the lint mitt 10*a*.

The disposable sheet 66 has an upper surface 68, a lower surface 70 and an outer periphery 72. The disposable sheet 66 has an adhesive 62*a* disposed upon at least a portion of one surface, and frequently has an adhesive 62*a* disposed upon a substantial portion of the one surface. Further, the disposable sheet 66 may have an adhesive 62*a* disposed on at least a portion of both the upper and lower surfaces 68 and 70, respectively. In another alternative (not shown), the disposable sheet 66 may have an adhesive 62*a* on one surface and a cohesive (not shown) on an opposing surface.

The disposable sheet 66 may be connected to the palm surface 12*a* of the lint mitt 10*a* via any adhesive 62*a* or cohesive material (not shown) disposed on the disposable sheet 66, an adhesive 62*a* or cohesive disposed on the palm surface 12*a* of the lint mitt 10*a*, or both. Further, the disposable sheet 66 may be connected to the lint mitt 10*a* via any means known in the art. As noted above, the palm surface 12*a* of the lint mitt 10*a* may be adapted to receive the disposable sheet 66 by having a different material, or, alternatively and/or in addition thereto, having an adhesive 62*a* or cohesive material (not shown) on at least a portion of the palm surface 12*a* for connecting the disposable sheet 66 thereto.

Figure 10:
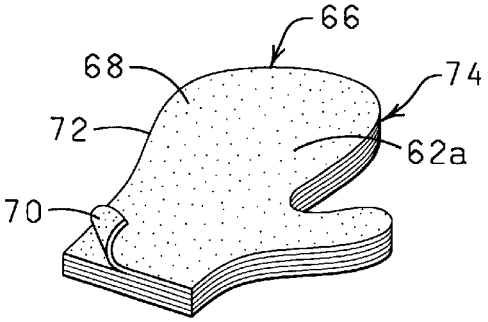
FIG. 10 is a perspective view of a pad formed from a plurality of disposable sheets of material, with the top disposable sheet of material shown partially detached.
Figure 11:
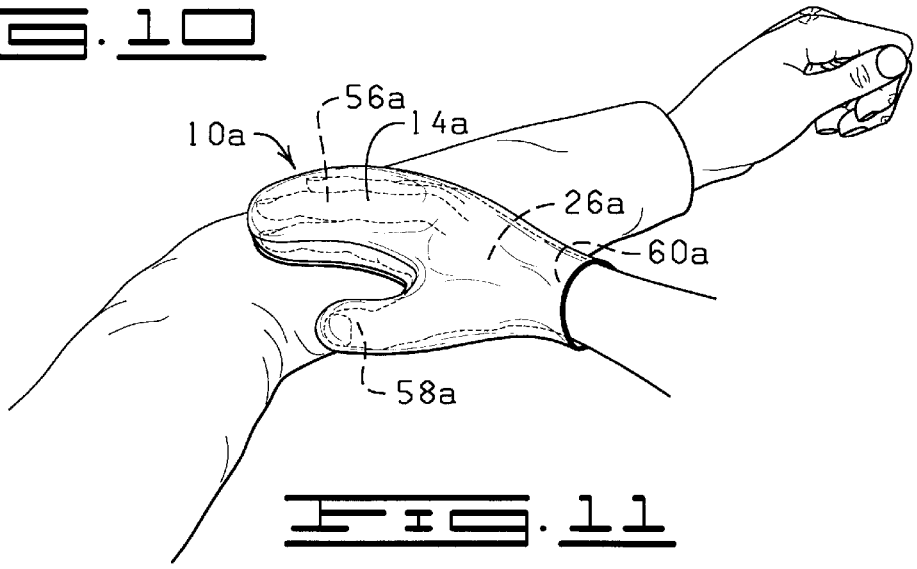
FIG. 11 is a perspective view of a user's hand in the lint mitt as shown in FIGS. 6–7, but showing the user partially encompassing an arm in a sleeve to remove the lint from the sleeve.

In addition, the disposable sheet 66 may be provided via a pad 74 having a plurality of disposable sheets 66. The plurality of disposable sheets 66 may be held together in the pad 74 via any adhesive 66 or cohesive material (not shown) applied to the disposable sheets 66, or by any other means known in the art. The disposable sheets 66 may be removed one at a time from the pad 74, as shown in FIG. 10, or, alternatively, a plurality of disposable sheets 66, connected together, may be removed, collectively, from the pad 74.

Figure 12:
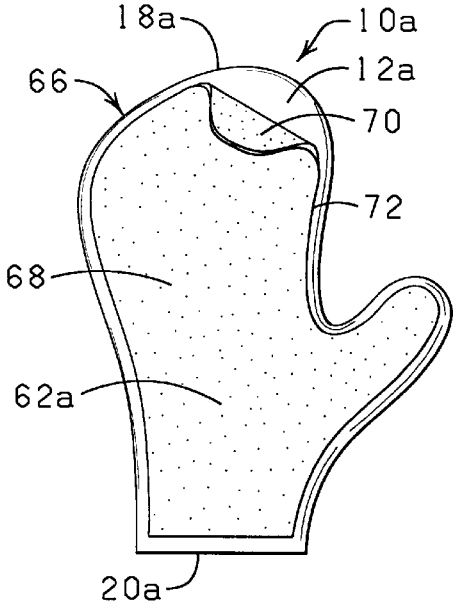
FIG. 12 is a top plan view of the lint mitt as shown in FIGS. 6–7, but showing the method of attaching/detaching the disposable sheet from the lint mitt.

One, several, or a complete pad 74 of disposable sheets 66 may be connected to the palm surface 12*a* of the lint mitt 10*a*. The palm surface 12*a* of the lint mitt 10*a* may have an adhesive 62*a* or a cohesive material (not shown) in order to hold the one or more disposable sheets 66 to the lint mitt 10*a*. The disposable sheet 66 will usually, but not by way of limitation, conform to the shape of the lint mitt 10*a*, as shown in FIG. 12. A single disposable sheet 66 may be readily connected or disconnected from the lint mitt 10*a*, as illustrated in FIG. 12, as can a plurality of disposable sheets 66.

Figure 7:
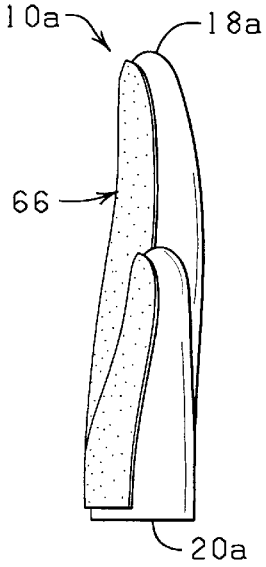
FIG. 7 is an elevational side view of the lint mitt shown in FIG. 6, showing a portion of the palm surface, the back surface and the disposable sheet from the side.

Turning now to a method of using the embodiments shown in FIGS. 6–12, a lint mitt 10a is provided as is a disposable sheet connected thereto, as shown in FIGS. 6–7. The user then pats, strokes and/or partially or completely encompasses a surface, such as the user's arm, to remove lint therefrom, as described in detail previously herein. When the disposable sheet 66 is filled with lint and the adhesive 62*a* on the disposable sheet 66 is no longer of adequate tackiness to cause lint to adhere to the disposable sheet 66, the disposable sheet 66 may be disconnected from the palm surface 12*a* of the lint mitt 10*a* and discarded, and another disposable sheet 66 placed thereon. Alternatively, as noted previously a plurality of disposable sheets 66, or a pad 74 of disposable sheets 66 may also be connected to the palm surface 12*a* of the lint mitt 10*a*. In this instance, when the top-most disposable sheet 66 becomes filled with lint, that disposable sheet 66 is removed by the same method as that shown in FIG. 12, and the next disposable sheet 66 is then exposed, and the process of filling each disposable sheet 66 with lint and then removing the lint-filled sheet to expose the next disposable sheet 66 is repeated until the lint is removed from the desired surface.

Finally, one final embodiment (not shown) would provide a lint mitt like the lint mitt 10 or the lint mitt 10*a*, described herein, but would provide an aperture for a user's thumb, without providing a compartment. Said aperture would act to hold the lint mitt 10 or 10a in place but would still act to prevent the lint mitt 10 or 10*a* from rotating about a user's wrist.

Changes may be made in the embodiments of the invention described herein, or in parts or elements of the embodiments described herein, or in the sequence of steps of the methods described herein, without departing from the spirit and/or scope of the invention as defined in the following claims.

What is claimed is:

1. A glove for removing lint, comprising:

a glove for disposing on a user's hand, the glove comprising a palm surface, and a back surface, the palm surface and the back surface forming the glove, the glove further comprising a top end and a bottom end, the glove having an opening at the bottom end, the opening defining an inner retaining space, the inner retaining space sized to hold a user's hand when inserted into the inner retaining space, the inner retaining space further comprising an aperture sized to permit a user's thumb to extend therethrough, a finger compartment for holding the glove about all of a user's fingers, a wrist compartment for at least a portion of a user's wrist, and holding means for holding the wrist compartment about a user's wrist, wherein the palm surface of the glove has connected thereto a pad having a plurality of sheets of material, each of the plurality of sheets of material having an adhesive disposed thereupon such that the adhesive is exposed for adhering lint thereto, each of the sheets of material in the pad detachable from the pad, wherein when the glove is disposed upon a user's wrist, the wrist compartment of the glove is held in a firm engagement about a user's wrist via the holding means thereby preventing the glove from sliding off of a user's hand, wherein the aperture of the glove retains the glove in a fixed position on a user's hand when a user's hand is inserted into the retaining space of the glove and a user's thumb is inserted into the aperture such that a user's palm is held adjacent the palm surface and a back of a user's hand is held adjacent the back surface of the glove, the glove is thereby being retained in a non-rotatable position about a user's hand, wherein adhesive on a top sheet of material in the pad of the plurality of sheets of material adheres lint thereto when a user disposes said top sheet of material upon a lint-covered surface, and wherein the top sheet of material is detachable from the pad of the plurality of sheets of material, another sheet of material having adhesive thereon forming a new top sheet of material when the top sheet of material is detached.

2. The glove of claim 1 wherein the glove is formed from two sheets of material.

3. The glove of claim 1 wherein the glove is formed from one sheet of material.

4. The glove of claim 1 wherein the glove is formed from a single web of material.

5. A method for removing lint using a lint glove, comprising the steps of:

providing a glove for disposing on a user's hand, said glove comprising a palm surface, and a back surface, the palm surface and the back surface forming the glove, the glove further comprising a top end and a bottom end, the glove having an opening at the bottom end, the opening defining an inner retaining space, the inner retaining space sized to hold a user's hand when inserted into the inner retaining space, the inner retaining space further comprising an aperture sized to permit a user's thumb to extend therethrough, a finger compartment for holding the glove about all of a user's fingers, a wrist compartment for at least a portion of a user's wrist, and holding means for holding the wrist compartment about a user's wrist, wherein the palm surface of the glove has connected thereto a pad having a plurality of sheets of material, each of the plurality of sheets of material having an adhesive disposed thereupon such that the adhesive is exposed for adhering lint thereto, each of the sheets of material in the pad detachable from the pad, wherein adhesive on a top sheet of material in the pad of the plurality of sheets of material adheres lint thereto when a user disposes said top sheet of material upon a lint-covered surface, and wherein the top sheet of material is detachable from the pad of the plurality of sheets of material, another sheet of material having adhesive thereon forming a new top sheet of material when the top sheet of material is detached, inserting a user's hand into the inner retaining space of the glove, a user's thumb being retained in the thumb compartment disposed in the aperture, a user's fingers being retained in the finger compartment and a user's wrist being disposed adjacent the wrist compartment;

binding the glove to the user's wrist via the holding means, wherein at least a portion of the wrist compartment of the glove is held in a firm engagement about the user's wrist thereby both retaining the glove on the user's hand and preventing rotation of the glove about the user's hand, disposing the top sheet of material upon a lint-covered surface to permit at least a portion of the lint from the lint-covered surface to adhere to adhesive on the top sheet of material, and detaching the top sheet of material from the pad when the the top sheet of material has lint adhered thereto.

6. The method of claim 5 wherein in the step of binding the glove to a user's wrist, the binding is performed by an element selected from the group consisting of an elastic element, a drawstring element, a pull tab, folding the glove, and crimping the glove.

7. The method of claim 5 wherein in the step of providing a glove, the glove is further defined as being formed from two sheets of material.

8. The method of claim 5 wherein in the step of providing a glove, the glove is further defined as being formed from one sheet of material.

9. The method of claim 5 wherein in the step of providing a glove, the glove is further defined as being formed from a single web of material.

10. A glove for removing lint, comprising:

a glove for disposing on a user's hand, the glove comprising a palm surface, and a back surface, the palm surface and the back surface forming the glove, the glove further comprising a top end and a bottom end, the glove having an opening at the bottom end, the opening defining an inner retaining space, the inner retaining space sized to hold a user's hand when inserted into the inner retaining space, the inner retaining space further comprising a thumb compartment sized to permit a user's thumb to extend therethrough, a finger compartment for holding the glove about all of a user's fingers, a wrist compartment for at least a portion of a user's wrist, and holding means for holding the wrist compartment about a user's wrist, wherein the palm surface of the glove has connected thereto a pad having a plurality of sheets of material, each of the plurality of sheets of material having an adhesive disposed thereupon such that the adhesive is exposed for adhering lint thereto, each of the sheets of material in the pad detachable from the pad, wherein when the glove is disposed upon a user's wrist, the wrist compartment of the glove is held in a firm engagement about a user's wrist via the holding means thereby preventing the glove from sliding off of a user's hand, wherein the thumb compartment of the glove retains the glove in a fixed position on a user's hand when a user's hand is inserted into the retaining space of the glove and a user's thumb is inserted into the thumb compartment such that a user's palm is held adjacent the palm surface and a back of a user's hand is held adjacent the back surface of the glove, the glove thereby being retained in a non-rotatable position about a user's hand, wherein adhesive on a top sheet of material in the pad of the plurality of sheets of material adheres lint thereto when a user disposes said top sheet of material upon a lint-covered surface, and wherein the top sheet of material is detachable from the pad of the plurality of sheets of material, another sheet of material having adhesive thereon forming a new top sheet of material when the top sheet of material is detached.

11. A glove for removing lint, comprising:

a glove for disposing on a user's hand, the glove comprising a palm surface, and a back surface, the palm surface and the back surface forming the glove, the glove further comprising a top end and a bottom end, the glove having an opening at the bottom end, the opening defining an inner retaining space, the inner retaining space sized to hold a user's hand when inserted into the inner retaining space, the inner retaining space further comprising a thumb compartment sized to permit a user's thumb to extend therethrough, a finger compartment for holding the glove about all of a user's fingers, wherein the palm surface of the glove has connected thereto a pad having a plurality of sheets of material, each of the plurality of sheets of material having an adhesive disposed thereupon such that the adhesive is exposed for adhering lint thereto, each of the sheets of material in the pad detachable from the pad, wherein the thumb compartment of the glove retains the glove in a fixed position on a user's hand when a user's hand is inserted into the retaining space of the glove and a user's thumb is inserted into the thumb compartment such that a user's palm is held adjacent the palm surface and a back of a user's hand is held adjacent the back surface of the glove, the glove thereby being retained in a non-rotatable position about a user's hand, wherein adhesive on a top sheet of material in the pad of the plurality of sheets of material adheres lint thereto when a user disposes said top sheet of material upon a lint-covered surface, and wherein the top sheet of material is detachable from the pad of the plurality of sheets of material, another sheet of material having adhesive thereon forming a new top sheet of material when the top sheet of material is detached.

12. A glove for removing lint, comprising:

a glove for disposing on a user's hand, the glove comprising a palm surface, and a back surface, the palm surface and the back surface forming the glove, the glove further comprising a top end and a bottom end, the glove having an opening at the bottom end, the opening defining an inner retaining space, the inner retaining space sized to hold a user's hand when inserted into the inner retaining space, the inner retaining space further comprising an aperture sized to permit a user's thumb to extend therethrough, a finger compartment for holding the glove about all of a user's fingers, wherein the palm surface of the glove has connected thereto a pad having a plurality of sheets of material, each of the plurality of sheets of material having an adhesive disposed thereupon such that the adhesive is exposed for adhering lint thereto, each of the sheets of material in the pad detachable from the pad, wherein the aperture of the glove retains the glove in a fixed position on a user's hand when a user's hand is inserted into the retaining space of the glove and a user's thumb is inserted into the aperture such that a user's palm is held adjacent the palm surface and a back of a user's hand is held adjacent the back surface of the glove, the glove thereby being retained in a non-rotatable position about a user's hand, wherein adhesive on a top sheet of material in the pad of the plurality of sheets of material adheres lint thereto when a user disposes said top sheet of material upon a lint-covered surface, and wherein the top sheet of material is detachable from the pad of the plurality of sheets of material, another sheet of material having adhesive thereon forming a new top sheet of material when the top sheet of material is detached.

* * * * *